United States Patent [19]

Johnson

[11] 4,215,773

[45] Aug. 5, 1980

[54] COIN-HANDLING DEVICE

[75] Inventor: Raymond A. Johnson, Hot Springs, Ark.

[73] Assignee: U.M.C. Industries, Inc., New York, N.Y.

[21] Appl. No.: 934,481

[22] Filed: Aug. 17, 1978

[51] Int. Cl.[2] ..... G07F 5/16

[52] U.S. Cl. ..... 194/9 R; 194/1 G; 194/1 M

[58] Field of Search ..... 194/1 L, 1 M, 1 N, 1 G, 194/9 R, 94, DIG. 3

[56] References Cited

U.S. PATENT DOCUMENTS

| | | | |
|---|---|---|---|
| 3,155,213 | 11/1964 | Erickson | 194/19 |
| 3,156,339 | 11/1964 | Kiefer et al. | 194/1 M |
| 3,186,532 | 6/1965 | Ellis et al. | 194/1 L X |
| 3,208,572 | 9/1965 | Jensen | 194/1 M |
| 3,929,212 | 12/1975 | Burzen | 194/1 L |

OTHER PUBLICATIONS

*The L-E-D EM Operation Parts and Service Manual,* NRI a Division of UMC Industries, Inc., pp. 1-13.

*The National EM Operation and Service Manual,* NRI a Division of UMC Industries, Inc., pp. 1-32.

*Primary Examiner*—F. J. Bartuska

*Attorney, Agent, or Firm*—Rogers, Eilers & Howell

[57] ABSTRACT

A coin-handling device responds to coins of at least three different values to establish corresponding credits on a movable credit-establishing element. A switch is closed in response to the insertion of each of those coins; and that switch energizes an electromechanical actuator to effect advancement of that credit-establishing element. Only that switch, that actuator, and the mechanical elements associated therewith are needed to effect the establishing of those corresponding credits.

41 Claims, 11 Drawing Figures

COIN-HANDLING DEVICE

FIELD OF THE INVENTION

Coin-operated machines, including any changemaking devices incorporated therein, receive coins and develop vending signals. Where the price of a desired vended product or service can be attained by the insertion of several coins, it is customary to provide a movable credit-establishing element and to provide coin-operated switches, electromechanical actuators and associated mechanical elements which will respond to the insertion of coins to cause that movable credit-establishing element to establish credits.

PRIOR ART

Erickson U.S. Pat. No. 3,155,213 and Ellis et al U.S. Pat. No. 3,186,532 show and describe Money-Handling Devices wherein mechanical elements directly respond to the insertion of coins of three specifically-different values to effect three corresponding advancements of a credit-establishing wheel. Neither of those Money-Handling Devices requires a coin-operated switch or an electromechanical actuator to effect advancements of that credit-establishing wheel. Each of the NATIONAL EM 08-52 and 08-56 Series Single Vend Price Coin Changers (hereinafter EM), which are made by National Rejectors Industries, Division of UMC Industries, responds to nickels, dimes and quarters to advance a credit-establishing wheel distances representing credits of five cents, ten cents and twenty-five cents. Each EM utilizes a nickel switch, a dime switch, a quarter switch, a five and ten cent solenoid assembly, and a twenty-five cent solenoid assembly plus associated mechanical elements to effect advancement of that credit-establishing wheel. An OPERATION and SERVICE MANUAL for the EM and a Supplement to the National EM Operation and Service Manual are in the file of this application. Each of the 08-66 and 08-62 Series L-E-D EM Single Vend Price Coin Changers (hereinafter L-E-D EM) which are made by National Rejectors Industries, Division of UMC Industries, responds to nickels, dimes and quarters to advance a credit-establishing wheel distances representing credits of five cents, ten cents and twenty-five cents. Each L-E-D EM utilizes a LED and a phototransistor to sense the insertion of a nickel, a second LED and a second phototransistor to sense the insertion of a dime, a third LED and a third phototransistor to sense the insertion of a quarter, and a solenoid assembly plus associated mechanical elements to effect advancement of that credit-establishing wheel. An OPERATION PARTS and SERVICE MANUAL for the L-E-D EM is in the file of this application.

SUMMARY OF THE INVENTION

The coin-handling device of the present invention responds to coins of at least three different values to establish corresponding credits on a movable credit-establishing element. A switch is closed in response to the insertion of each of those coins; and that switch energizes an electromechanical actuator to effect advancement of that credit-establishing element. Only that switch, that actuator, and the mechanical elements associated therewith are needed to effect the establishing of those corresponding credits. It is, therefore, an object of the present invention to provide a coin-handling device which requires only one coin-operated switch, only one electromechanical actuator, and the mechanical elements associated therewith to respond to coins of at least three different values to establish corresponding credits on a movable credit-establishing element.

Other and further objects and advantages of the present invention should become apparent from an examination of the drawing and the accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

DETAILED DESCRIPTION OF PREFERRED EMBODIMENT

Figure 1:
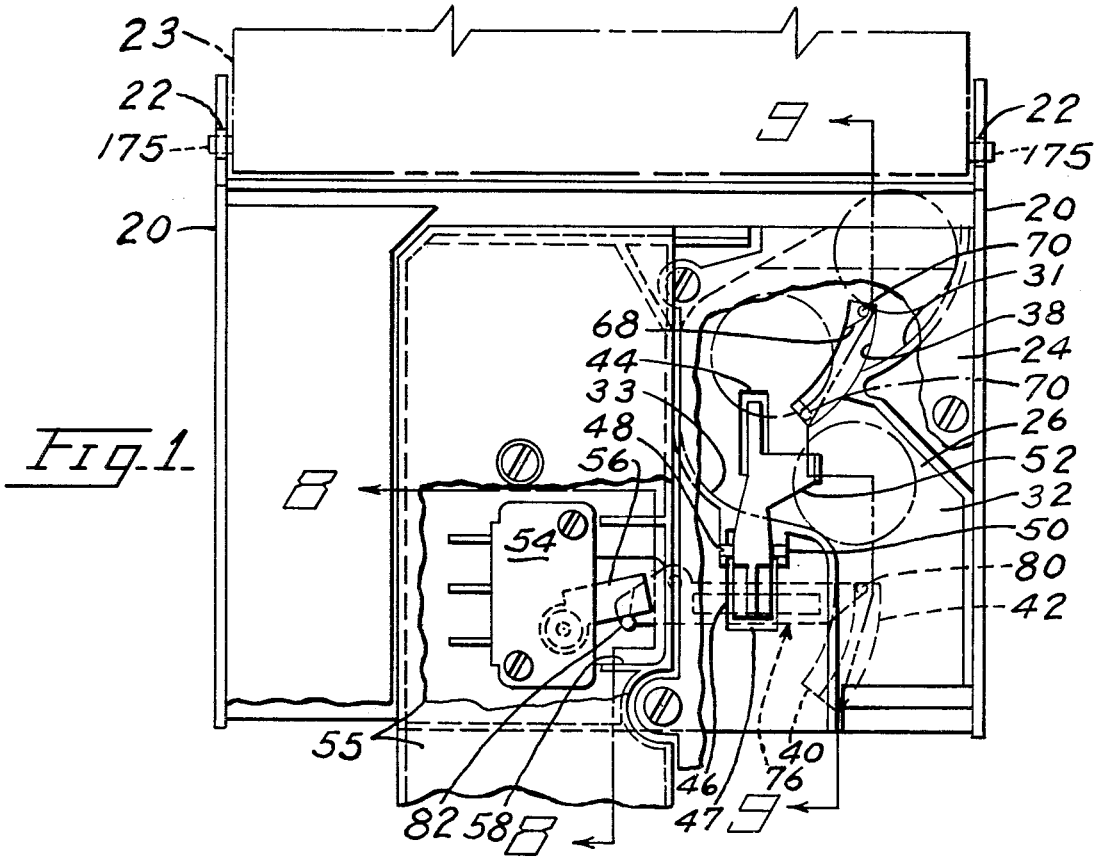
FIG. 1 is a front elevational view of one preferred embodiment of coin-handling device provided by the present invention wherein portions of the structure have been broken away to show the coin-operated switch and also to show part of the passageway for a unit-value coin.

Referring to the drawing in detail, numeral 20 generally denotes a U-shaped supporting frame, for the coin-handling device of the present invention, which is dimensioned to fit within the overall supporting frame of an EM or of an L-E-D EM. The frame 20 and the elements supported thereby can be substituted for the 5¢–10¢ coin switch, the 10¢ coin switch, the 25¢ coin switch, and the 25¢ solenoid of an EM, or can be substituted for the three LED's, the three phototransistors, the transformer, the electronic power supply, and the electronic pulsing circuit of an L-E-D EM. Numeral 22 denotes notches adjacent the upper ends of the side walls of frame 20; and those notches are dimensioned to accommodate the lower pins on the frame of a slug rejector 23 of standard and usual form. Numerals 24, 26, 28 and 30 denote walls which are shown particularly by FIG. 9 and which are disposed forwardly of the center wall of frame 20. Walls 24 and 26 define a passageway 32 for a unit value coin which is a nickel in the U.S. monetary system. Walls 26 and 28 define a passageway 34 for a higher value coin which is a dime in the U.S. monetary system; and the walls 28 and 30 define a passageway 36 for a still higher value coin which is a quarter in the U.S. monetary system. As shown particularly by FIG. 1, the passageway 32 has a concave portion 31 which inclines downwardly from upper right to lower left to force nickels to move to the left; and it also has a concave portion 33 which inclines downwardly from left to right to force nickels to move to the right. As shown particularly by FIG. 2, the passageway 34 has the upper end of the right hand portion thereof inclined downwardly from right to left at a shallow angle to the vertical to force dimes to move to the left; and it has the lower end of that portion inclined downwardly from upper left to lower right at an angle of about forty-five degrees to the vertical to permit dimes to move to the right. As shown particularly by FIG. 4, the passageway 36 has an abutment 37 of triangular configuration adjacent the lower end of the right-hand portion thereof; and that abutment forces quarters to move to the left and then permits them to move to the right.

The numeral 38 denotes an arcuate slot in the walls 26 and 28, and that slot is shown in FIGS. 1–3 and 9. That slot is in the upper right-hand portions of those walls; and it inclines downwardly from upper right to lower left. The numeral 40 denotes an arcuate slot in the walls 26, 28 and 30, and that slot is shown in dotted lines in FIG. 1 and in solid lines in FIGS. 2–4 and 9. That slot is in the lower right-hand portions of those walls, and it inclines downwardly from upper right to lower left.

The numeral 42 denotes an arcuate recess in the rear face of wall 26; and that recess is shown by dotted lines in FIG. 1. The inner radius of that recess is the same as the outer radius of slot 40; but the outer radius of recess 42 is larger than any radius of that slot. The upper and lower ends of the recess 42 are defined by the same lines which define the upper and lower ends of slot 40. The numeral 44 denotes a recess in the front face of wall 26; and that recess is shown in FIG. 1. That recess is rectangular in front elevation, it has the long axis thereof vertically directed, and it is located above the lower section of the concave portion 33. The numeral 46 denotes a slot in the wall 26; and that slot is shown in FIG. 1. That slot is rectangular in front elevation, it has the long axis thereof vertically directed, and it is located below the concave portion 33. A shallow recess 47 is provided in the front face of wall 26; and that recess is shown in FIG. 1. That recess is below, but is contiguous with, the lower end of slot 46. Sockets 48 and 50 are provided at the front face of wall 26, as shown by FIG. 1. Those sockets are close to the under surface of the concave portion 33; and they accommodate pivots which extend outwardly from both sides of a coin deflector 52. The recesses 44 and 47, the slot 46, the sockets 48 and 50, and the coin deflector 52 are not, per se, parts of the present invention. Those recesses, that slot, those sockets, and that coin deflector are provided to prevent overfilling of the nickel tube of the EM with which the coin handling device of the present invention is used.

The numeral 54 denotes a single pole, double throw switch that has a rotatable switch arm 56; and that switch arm is located adjacent a generally-rectangular opening 58 in wall 26, as shown particularly by FIG. 1. Whenever that switch arm is in the position shown by FIG. 1, that switch will keep a circuit "open"; but, when that switch arm is rotated in the counterclockwise direction, it will "close" that circuit. A cover 55 protects that switch.

Figure 2:
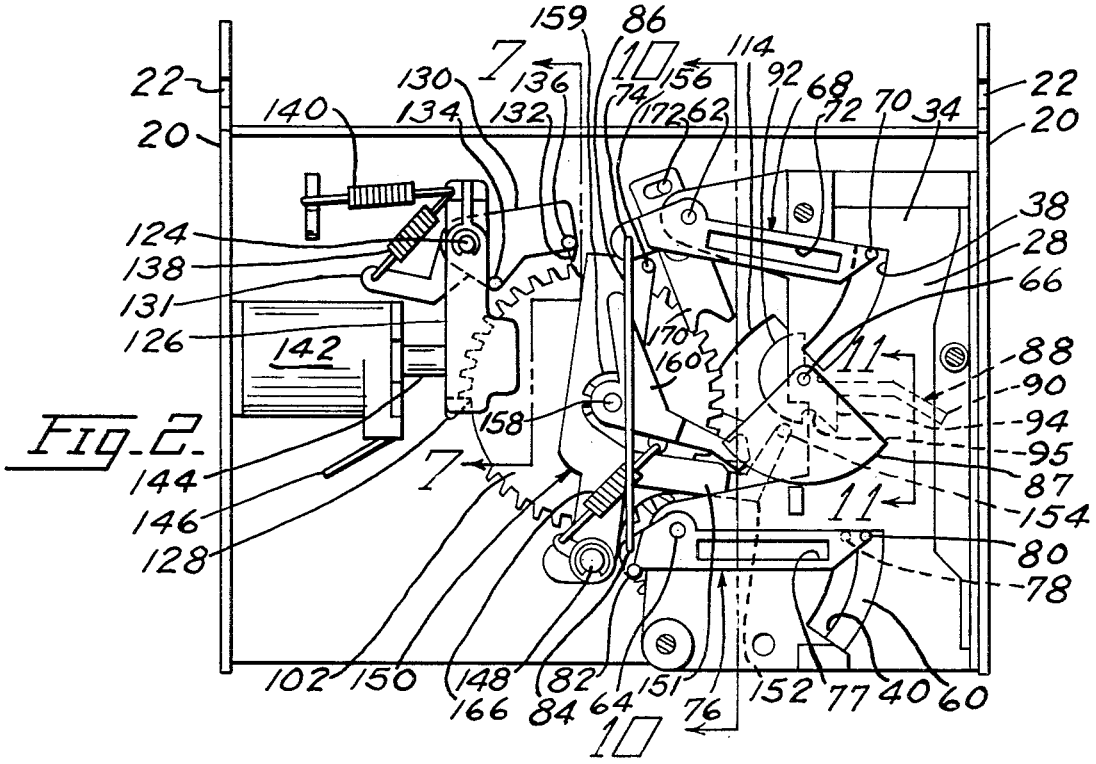
FIG. 2 is a front elevational view of the coin-handling device of FIG. 1 wherein further portions of the structure have been removed to show the passageway for a higher value coin and also to show a stepping wheel and some of the controlling elements for that stepping wheel.
Figure 3:
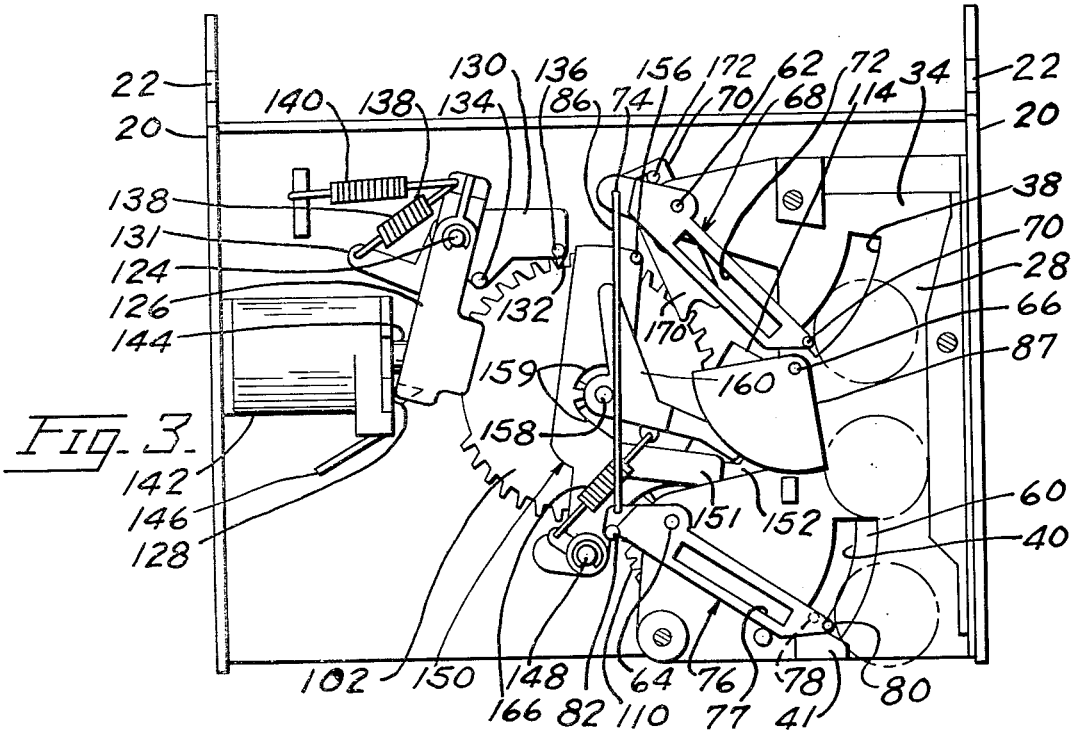
FIG. 3 is a view which is similar to FIG. 2, but it shows three positions which a higher value coin occupies in passing through the passageway therefor.

The numeral 60 denotes an arcuate recess in the front face of wall 28; and FIGS. 2 and 3 show that recess abutting the slot 40. The inner radius of that recess and the outer radius of that slot are the same, but the outer radius of that recess is larger than any radius of that slot. The upper and lower ends of recess 60 are defined by the lines which define the upper and lower ends of slot 40.

Figure 4:
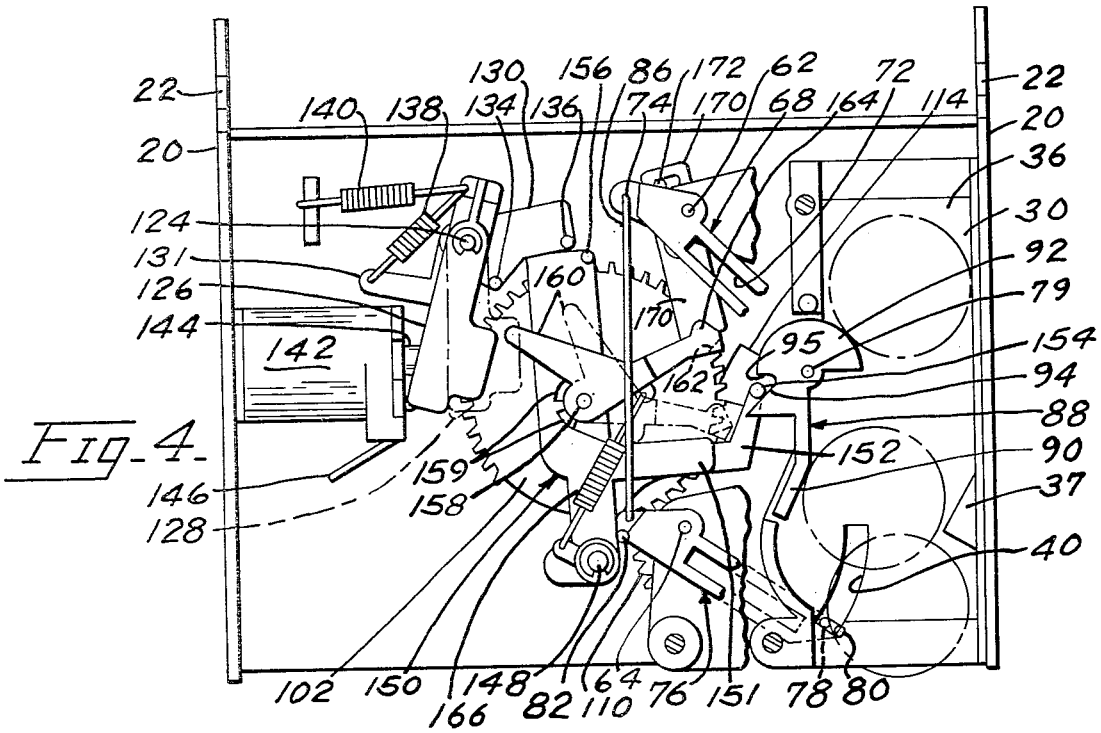
FIG. 4 is a partially-broken, front elevational view of the coin-handling device of FIG. 1 after sufficient structure has been removed to show the passageway for a still higher value denomination coin and also to show the stepping wheel and some of the controlling elements for that stepping wheel.

The numerals 62, 64, and 66 in FIGS. 2–4 denote horizontally-directed pivots which extend forwardly from the front face of wall 28. The pivots 62 and 64 are in verticular registry; but the pivot 66 is disposed to the right of those pivots. The numeral 68 generally denotes a lever which is rotatably mounted on the pivot 62; and that lever is shown in full in FIGS. 2, 3 and 9 and is shown in part in FIGS. 1 and 4. That lever has a generally-rectangular portion which extends to the right from the pivot 62 and which is disposed between walls 26 and 28, as indicated particularly by FIG. 9. That generally-rectangular portion has an elongated rectangular slot 72 therein and it has a pin-like coin-receiving abutment 70 adjacent the free end thereof. As indicated particularly by FIG. 9, that abutment spans the passageway 32, spans the passageway 34, and extends into the slot 38 in wall 28. As shown by FIGS. 1–3, that abutment lies in the path of each nickel which moves downwardly through the passageway 32, and also lies in the path of each dime which moves downwardly through the passageway 34. By extending into the slot 38 of wall 28, the abutment 70 keeps dimes from slipping between that abutment and that wall. As a result each inserted nickel and each inserted dime will engage and move the abutment 70 on lever 68. The numeral 74 denotes an opening in a rearwardly-offset, left-hand portion of lever 68; and that opening is disposed a short distance to the left of pivot 62, whereas abutment 70 is disposed a substantial distance to the right of that pivot.

Figure 8:
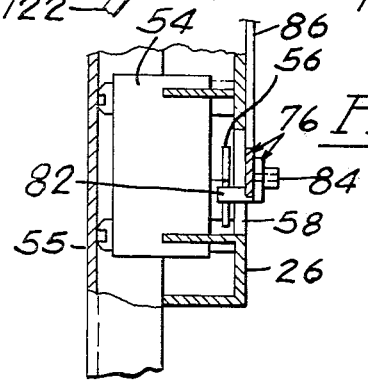
FIG. 8 is a sectional view which is taken along the broken plane indicated by the borken line 8—8 in FIG. 1.
Figure 9:
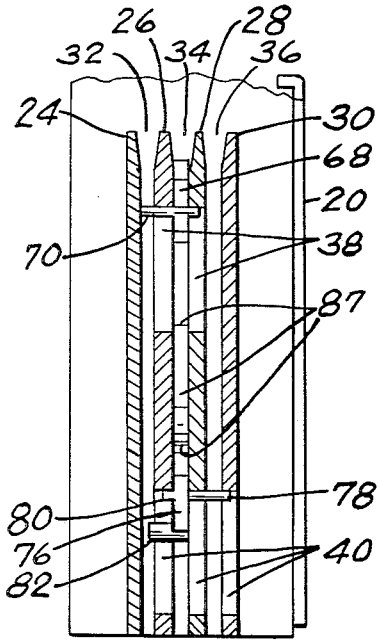
FIG. 9 is a sectional view which is taken along the broken plane indicated by the broken line 9—9 in FIG. 1.

The numeral 76 generally denotes a lever which is rotatably supported by the pivot 64; and that lever is shown in full in FIGS. 2, 3 and 9 and is largely shown by dotted lines in FIGS. 1 and 4. That lever has a generally-rectangular portion which extends to the right from the pivot 64 and which is disposed between walls 26 and 28, as indicated particularly by FIG. 9. That generally-rectangular portion has an elongated rectangular slot 77 therein, has a coin-receiving free end, has a short-pin-like abutment 80 extending forwardly from that free end as shown by FIGS. 2–4 and 9, and has a pin-like abutment 78 extending rearwardly therefrom at a point close to that free end as shown by FIGS. 2–4 and 9. The forward end of the abutment 80 extends into the arcuate recess 42 in the rear of wall 26 to keep dimes from slipping between that wall and the front end of the generally-rectangular portion. The abutment 78 spans the passageway 36 and extends into the slot 40 in wall 30. As a result, each inserted dime will engage and move the free end of the generally-rectangular portion of lever 76; and each inserted quarter will engage and move the abutment 78 adjacent that free end. A pin 82 extends forwardly from the left-hand portion of lever 76, as indicated by FIGS. 1–4, 8 and 9; and a sleeve 84 extends rearwardly from a rearwardly-offset part of that left-hand portion, as indicated by FIG. 8. That sleeve is disposed a short distance to the left of pivot 64, whereas abutment 78 and the free end of the generally-rectangular portion of lever 76 are disposed substantial distances to the right of that pivot.

The sleeve 84 on the left-hand portion of the lever 76 has the axis thereof directed horizontally, and the opening 74 in the left-hand portion of lever 68 also has its axis directed horizontally. That sleeve and that opening have the axes thereof in vertical registry; and that sleeve and that opening receive the rearwardly-directed upper and lower ends of a wire-like connecting line 86. That connecting link forces conjoint rotation of levers 68 and 76 about the pivots 62 and 64, respectively.

The numeral 87 denotes a coin-retarding member which is rotatably supported within passageway 34 by pivot 66, as shown by FIGS. 2, 3 and 9. That member has the configuration of one-quarter of a circle; and the right-hand portion thereof extends into the paths of the dimes which move downwardly through that passageway as indicated particularly by FIGS. 2 and 3. That coin-retarding member is light enough in weight so each dime can move it from the normal position shown in FIG. 2 to the moved position of FIG. 3. After a dime has moved the coin-retarding member 87 from the position of FIG. 2 to the position of FIG. 3, and then has moved downwardly past that member, that member will respond to the force of gravity to return to the position of FIG. 2.

The numeral 88 in FIGS. 2 and 4 generally denotes a lever which is rotatably mounted on a pivot 79 that extends forwardly from wall 30. That lever has a coin-receiving portion 90 which is shown in the form of an elongated arm with a downwardly-bent end; and that portion is disposed within, and normally extends transversely of, the passageway 36, as indicated by dotted lines in FIG. 2. However, that coin-receiving portion can respond to each inserted quarter to move to the downwardly-directed position of FIG. 4. The lever 88 has a semi-cylindrical abutment 92; and that abutment and the coin-receiving portion 90 are disposed on opposite sides of the pivot 79. A cam-like portion 94 on lever 88 inclines downwardly from upper left to lower right in FIG. 2, and that portion is displaced from the semi-cylindrical abutment 92 by a notch 95.

Figure 6:
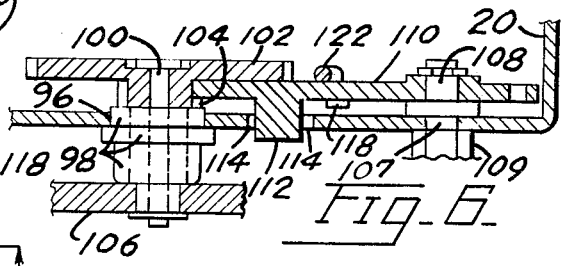
FIG. 6 is a sectional view which is taken along the broken plane indicated by the broken line 6—6 in FIG. 5.
Figure 7:
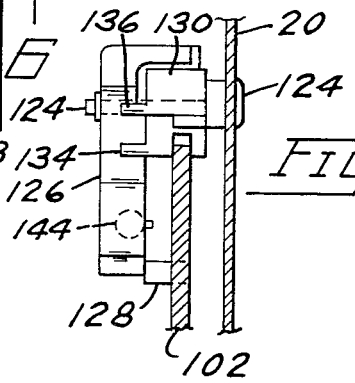
FIG. 7 is a sectional view which is taken along the broken plane indicated by the broken line 7—7 in FIG. 2.
Figure 10:
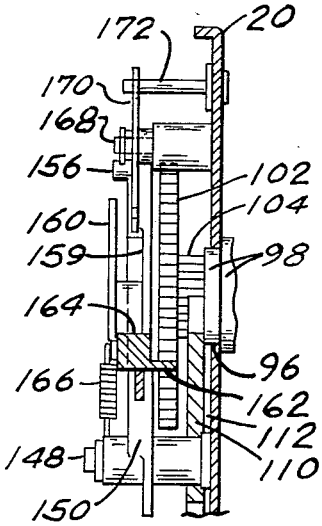
FIG. 10 is a sectional view which is taken along the plane indicated by the line 10—10 in FIG. 2.
Figure 11:
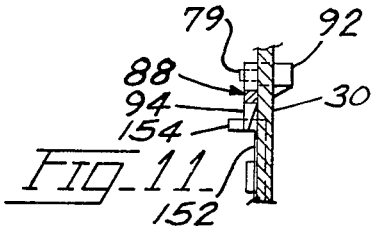
FIG. 11 is a sectional view which is taken along the plane indicated by the line 11—11 in FIG. 2.

The numeral 96 in FIGS. 6 and 10 denotes a circular opening in the frame 20; and an anti-friction bearing 98 is disposed within that opening. A shaft 100 is rotatable within the bearing 98; and a stepping wheel 102, which has an integrally-formed pinion 104 thereon, is fixedly secured to one end of that shaft. The numeral 106 denotes a price selection cam, which can be identical to the price selection cam in an EM, or in an L-E-D EM, and which is fixedly secured to the other end of shaft 100.

Figure 5:
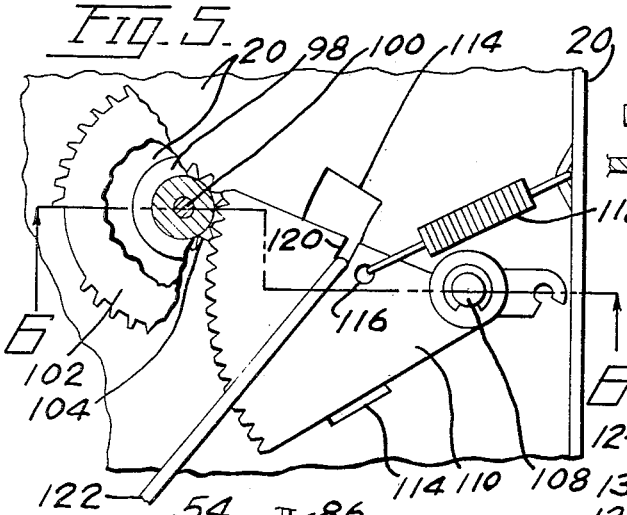
FIG. 5 is a partially-sectioned, partially broken-away, front elevational view of the coin-handling device of FIG. 1 after sufficient structure has been removed to show a pinion which is part of the stepping wheel and also to show a gear segment which meshes with that pinion.

The numeral 108 in FIGS. 5 and 6 denotes a shouldered screw which extends through an opening 107 in the center wall of the frame 20, which seats in a hexagonal nut 109, and which serves as a pivot. That hexagonal nut supports further components not shown, of the credit system of an EM or L-E-D EM. The screw 108 rotatably supports a gear segment 110 which has the teeth thereof in engagement with the teeth of pinion 104, as shown by FIGS. 5 and 6. An abutment 112, at the rear face of that gear segment, extends into an arcuate slot 114 which is in the center wall of frame 20 and is shown by FIGS. 2–6. A small hole 116 is formed in the upper portion of gear segment 110, as shown by FIG. 5; and a shallow notch 120 is provided in the upper edge of that gear segment to the left of that hole. A helical extension spring 118 has one end thereof hooked through the hole 116, and has the other end thereof hooked through an inwardly-punched eye in the right-hand wall of frame 20. That spring biases gear segment 110 for rotation in the clockwise direction, and hence biases the pinion 104 and the stepping wheel 102 for rotation in the counter clockwise direction. An elongated rod 122 has the upper end thereof hooked in the notch 120; and the lower end of that rod extends to a restoring cam in the EM or L-E-D EM.

The numeral 124 in FIGS. 2–4 denotes a pivot which extends forwardly from the upper left-hand portion of the center wall of frame 20; and an escapement lever 126, which has a tooth 128 adjacent the bottom thereof, is rotatably mounted on that pivot. A further escapement lever 130, which has a tooth 132 at the right-hand end thereof and which has a bent arm 131 extending from the left-hand end thereof, also is rotatably mounted on pivot 124. A pin-like abutment 134 extends forwardly from lever 130 and is in register with a portion of lever 126, and a further pin-like abutment 136 extends forwardly from lever 130 and is close to the tooth 132. A helical extension spring 138 has one end thereof hooked through an opening in the top of lever 126 and has the other end thereof hooked through an opening in the bent arm 131 of lever 130. That spring biases abutment 134 on lever 130 into engagement with the right-hand edge of lever 126, as shown by FIG. 2; but that spring can yield to permit lever 126 to rotate away from abutment 136, as shown by FIGS. 3 and 4. The levers 126 and 130 and the spring 138 constitute an escapement mechanism 126, 130 and 138 which is identical to the escapement mechanism in an EM or in an L-E-D EM and which is mounted adjacent the stepping wheel 102.

An electromechanical actuator 142, which is shown as a solenoid, is secured to the left-hand wall of frame 20; and the outer end of the armature 144 of that actuator is pinned to the lower end of lever 126. One terminal of the coil of that actuator is denoted by the numeral 146. One end of a helical extension spring 140 is hooked through the opening in the upper end of lever 126, and the other end of that spring is hooked through an eye which is punched forwardly from the center wall of frame 20, as shown by FIGS. 2–4. Whenever the actuator 142 is de-energized, the spring 140 will hold the escapement mechanism 126, 130 and 138 in the position of FIG. 2. However, energization of that actuator will rotate lever 126 to the position shown by FIGS. 3 and 4.

The numeral 148 in FIGS. 2–4 and 10 denotes a pivot which extends forwardly from the middle of the lower portion of the center wall of frame 20. The numeral 150 generally denotes a lever which has a vertically-directed portion with an arcuate recess 159 in the front thereof, which has a generally horizontally-directed arm 151 with an upwardly-inclined extension 152 at the right-hand end thereof, which has a pin-like abutment 154 extending forwardly from the upper end of that extension, which has a pin-like abutment 156 extending forwardly from the upper end of the vertically-directed portion thereof, and which has a pivot 158 extending forwardly from the recess 159. The numeral 160 denotes a generally V-shaped lever which is rotatably mounted on the pivot 158. That lever has a tooth 162 at the rear face thereof adjacent the right-hand end thereof; and it has an upwardly projecting abutment 164 of generally-triangular configuration above the level of that tooth. A helical extension spring 166 has one end thereof hooked through an opening in a boss at the lower edge of lever 160 and has the other end hooked through an opening in a boss on the hub of lever 150. That spring urges the right-hand end of lever 160 into engagement with the upper surface of that right-hand end of arm 151 of lever 150; but that spring can yield to permit the right-hand end of lever 160 to rotate away from that upper surface as shown by solid lines in FIG. 4.

The numeral 168 in FIG. 10 denotes a pivot which extends forwardly from the upper portion of the center wall of frame 120. A motion limiter 170, which has a notch in the lower end thereof and which has a slot in the upper end thereof, is rotatably mounted on that pivot. A stop 172 extends forwardly from the upper portion of the center wall of frame 20 to extend into the slot in the motion limiter 170, as indicated particularly by FIGS. 2–4 and 10. That stop holds the notch in the lower end of motion limiter 170 close to the pitch line of stepping wheel 102.

Operation by a Nickel

When a nickel is inserted in the coin slot of the coin-operated machine, with which the coin-handling device of FIGS. 1–10 is used, that nickel will be tested by the slug rejector 23. If it is found to be authentic, that nickel will be directed to the passageway 32; and it will engage, and move, the coin-receiving abutment 70 on lever 68. The concave portion 31 of passageway 32 will cause the nickel to move from right to left, and hence will cause it to generally follow the arcuate path which coin-receiving abutment 70 will follow in moving from its normal upper position in FIG. 1 to the moved lower position shown in FIG. 1. The resulting clockwise rotation of lever 68 will raise the connecting link 86, and will thereby force the lever 76 to rotate in the clockwise direction toward the position of FIG. 3. As lever 76 rotates toward that position, the pin 82 at the left-end thereof will move upwardly and rotate the arm 56 of switch 54 in the counter clockwise direction.

The resulting "closing" of the circuit of actuator 142 by that switch will energize that actuator; and armature 144 will move to the left to shift the escapement mechanism 126, 130 and 138 from the position of FIG. 2 to the position of FIG. 3. During that shifting of that escapement mechanism, the stepping wheel 102 will respond to the bias, which is applied by spring 118, gear segment 110 and pinion 104, to start rotating in the counter clockwise direction. However, as tooth 128 moves out of the path of the teeth on that stepping wheel, the tooth 132 on lever 130 will move into the path of those teeth, as indicated by FIG. 3. Consequently, that stepping wheel will advance a distance which is less than the center-to-center spacing of two adjacent teeth.

The nickel will then pass to the left of the abutment 70 on lever 68, and thereby free that lever for movement back to the normal position of FIG. 2. The force of gravity and the restoring spring, not shown within switch 54 bias levers 68 and 76 and connecting link 86 for movement back to that position; and hence those levers will promptly move back from the position of FIG. 3 to the position of FIG. 2. The nickel will continue to move downwardly through passageway 32; and it will be guided to the right by the concave portion 33 of passageway 32 so it will fall to the cash box of the coin-operated machine.

As lever 68 returns to the position of FIG. 2, the connecting link 86 will permit lever 76 to return to the position of FIG. 2; and, at such time, the pin 82 on the latter lever will move downwardly and permit re-opening of the circuit of actuator 142. Thereupon, spring 140 will rotate the escapement mechanism 126, 130 and 138 in the counter clockwise direction about the pivot 124. During that rotation, the tooth 132 will be moved out of the path of the teeth on stepping wheel 102, and the tooth 128 will be moved back into the path of those teeth; and that stepping wheel will advance until it is held by the latter tooth. As the stepping wheel 102 so advances, it will advance the price selection cam 106 an equal distance. All of this means that an inserted nickel will cause the actuator 142, spring 140, and escapement mechanism 126, 130 and 138 to permit stepping wheel 102, and hence price selection cam 106, to advance in the counter clockwise direction one step—which is a distance that is equal to the center-to-center spacing of two adjacent teeth on that wheel and which represents a credit of five cents.

FIG. 1 shows three of the infinite number of positions which a nickel will occupy as it passes through the passageway 32. In the uppermost of those positions, the nickel has just engaged the abutment 70 on lever 68, and is starting to move that abutment and lever downwardly. In the second of those positions, the nickel has moved the abutment 70 and the lever 68 to the lower end of slot 38, and is about to roll off that abutment to free that abutment and lever for movement back up to the position of FIG. 2. In the lowermost of those positions, the nickel has freed the abutment 70, that abutment and lever 68 have moved back to the position of FIG. 2, and the nickel is moving along the concave portion 33 toward the cash box or payout tube of the money operated machine.

Operation by a Dime

An authentic dime will be tested by slug rejector 23 and then delivered to passageway 34. Abutment 70 on lever 68 will be moved downwardly through passageway 34 from the position of FIG. 2 toward the position of FIG. 3 by that dime and then freed for movement back up to the position of FIG. 2. The inclined upper portion of the right-hand portion of passageway 34 will cause the dime to generally follow the path followed by abutment 70 in slot 38. The connecting link 86 will cause lever 76 to rotate toward the position of FIG. 3 and then will permit it to return to the position of FIG. 2; and hence pin 82 on that lever will cause switch 54 to energize then de-energize actuator 142. The consequent oscillation of escapement mechanism 126, 130 and 138 will permit stepping wheel 102 to advance one step, and thereby store a five cents credit on the price selection cam 106.

The dime will continue to move downwardly through passageway 34; and, as it does so, it will engage coin-retarding member 87 and rotate that member from the position of FIG. 2 to the position of FIG. 3. The mass of that coin-retarding member will enable that member to delay the downward movement of the dime until the levers 68 and 76 have had ample time to return to the positions of FIG. 2. As the dime moves downwardly past coin-retarding member 87, that member will return to the position of FIG. 2, and the dime will engage the right-hand end of the generally-rectangular portion of lever 76 and rotate that lever to the position of FIG. 3. The resulting raising of switch arm 56 by pin 82 will cause actuator 142 to initiate a further oscillation of the escapement mechanism 126, 130 and 138. As the right-hand end of the generally-rectangular portion of lever 76 reaches the lower end of slot 40, a deflector 41 in the passageway 34 will force the dime to move to the right and pass to the cash box of the money-operated machine. As the dime moves toward that cash box, it will free the lever 76 and that lever will move back up to the position of FIG. 2, and switch 54 will de-energize actuator 142. Thereupon, spring 140 will complete the oscillation of escapement mechanism 126, 130 and 138. The overall result is that an inserted dime will move lever 68 to cause a five cent credit to be stored by price selection cam 106, and then that dime will move lever 76 to cause a further five cent credit to be stored by that cam.

FIG. 3 shows three of the infinite number of positions which a dime will occupy as it passes through the passageway 34. In the uppermost of those positions, the dime has moved the abutment 70 and lever 68 downwardly to the end of slot 38 and is rolling off of that abutment to permit that abutment and lever to move back up to the position of FIG. 2. In the second of those positions, the dime has engaged the motion-retarding member 87 and has rotated it from the position of FIG. 2 to the position of FIG. 3 but has been delayed in doing so. In the lowermost position, the dime has moved the right-hand end of the generally-rectangular portion of lever 76 to the lower end of slot 40, and it will then pass to the cash box of the money-operated machine.

Operation by a Quarter

An authentic quarter will be tested by slug rejector 23 and then delivered to passageway 36. The coin-receiving portion 90 of lever 88 will be moved downwardly by the quarter from the normal position which is shown by dotted lines in FIG. 2 to the moved position which is shown by FIG. 4. During that movement, the leading portion of the semi-cylindrical abutment 92 will move into the passageway 36, the trailing portion of that abutment will move out of the path of the pin-like abutment 154 on the extension 152 of arm 151 of lever 150, and the cam-like portion 94 of lever 88 will raise abutment 154 from the dotted-line position of FIG. 2 to the solid-line position of FIG. 4. As that abutment is raised, it will rotate the lever 150 in the counter clockwise direction from the position of FIG. 2 to the position of FIG. 4; and that rotation will move the upper end of the vertically-directed portion of lever 150 into position beneath the free end of escapement lever 130, and also will shift the pivot 158 to the left to pull the tooth 162 on lever 160 into the path of the teeth on stepping wheel 102 and to pull abutment 164 on that lever close to the pitch line of those teeth. Dotted lines in FIG. 4 show the position of lever 160 after it has been pulled to the left by the shifting of pivot 158 during the counter clockwise rotation of lever 150, and solid lines show the position which lever 160 assumes at the end of its counter clockwise rotation.

As the quarter continues to move downwardly through passageway 36, the abutment 37 will force that quarter to move to the left so that quarter will be sure to move the abutment 78 on lever 76 toward the bottom of slot 40. The resulting rotation of lever 76 to the position of FIGS. 3 and 4 will cause the pin 82 to raise switch arm 56, and thereby cause switch 54 to energize actuator 142. Thereupon, armature 144 will pull escapement lever 126 to the position of FIG. 4, and spring 138 will urge escapement lever 130 toward the position of FIG. 3; but the upper end of the vertically-directed portion of lever 150 will hold escapement lever 130 in the position of FIG. 4. At such time, the tooth 132 on lever 130 will be held up out of the path of the teeth on stepping wheel 102, and the tooth 128 on lever 126 also will be held out of the path of those teeth; and hence the bias, which is provided by spring 118, gear segment 110 and pinion 104, will cause that stepping wheel to rotate in the counter clockwise direction. Because the tooth 162 on lever 160 is in the path of the teeth on that stepping wheel, that lever and that stepping wheel will move as a unit. That lever and that stepping wheel will rotate in the counter clockwise direction until the abutment 164 on that lever engages, and is held against further movement by, the notch in the bottom of motion limiter 170. That notch is spaced far enough above the normal position of the abutment 164 so the stepping wheel 102 can rotate a distance which is almost five times the distance through which that stepping wheel advances when a nickel is inserted. As a result, in moving from the position of FIG. 3 to the position of FIG. 4, the lever 160 and the stepping wheel 102 permit the price selection cam 106 to advance a distance which represents twenty-five cents.

The lower end of abutment 37 in passageway 38 will permit the quarter to roll past the abutment 78 on lever 76; and thereafter that lever will move back up to the position of FIG. 2. The resulting downward movement of switch arm 56 will permit switch 54 to de-energize actuator 144; and the spring 140 will then rotate escapement lever 126 toward the position of FIG. 2, wherein the tooth 128 on that lever will lie in the path of the teeth on stepping wheel 102. As escapement lever 126 moves toward the position of FIG. 2, the right-hand face of the right-hand offset near the lower end of that lever will engage the left-hand end of lever 160 and will force that lever to move to the right. The lever 150 will respond to such movement of lever 160 to rotate in the clockwise direction, and the motion limiter 170 will respond to such movement of lever 160 to rotate in the counter clockwise direction. After the escapement lever 126 has rotated far enough to dispose the tooth 128 in the path of the teeth on stepping wheel 102, the right-hand face of the right-hand offset on that lever will move the lever 160 far enough to the right to move the tooth 162 thereon out of the path of the teeth on that stepping wheel. Thereupon, that stepping wheel will rotate just a very short distance until a tooth thereon is intercepted and held by the tooth 128 on escapement lever 126. Also, the lever 160 will rotate downwardly until its right-hand end rests upon the arm 151 of lever 150.

The center of gravity of lever 88 is disposed to the left of pivot 79; and hence that lever will tend to return to the position of FIG. 2 as soon as the quarter has moved downwardly below the free end of the coin-receiving portion 90. However, the abutment 154 on the extension 152 of arm 151 on lever 150 will intercept the trailing end of the semi-cylindrical abutment 92 after lever 88 has rotated just a few degrees toward the position of FIG. 2; and hence that lever will remain close to the position of FIG. 4 as long as actuator 142 remains energized. Subsequently, the clockwise rotation which the lever 150 experiences, as the de-energized actuator 142 permits escapement lever 126 to shift lever 160 to the right, will move the abutment 154 out of the path of the semi-cylindrical abutment 92; and at that time, the lever 88 will rotate back to the dotted-line position of FIG. 2.

The inserted quarter thus acted through lever 88 to cause lever 150 to move into position to block clockwise rotation of escapement lever 130, to move tooth 162 on lever 160 into the path of the teeth on stepping wheel 102, and to move the abutment 164 close to the pitch line of those teeth; and then subsequently acted through lever 76 to cause switch 54 to energize actuator 142. Thereupon, escapement lever 126 freed that stepping wheel for a five-step advancement until the abutment 164 on lever 160 engaged, and was held by, the notch of motion limiter 170; and the price selection cam 106 made a corresponding advancement. Thereafter, that quarter freed lever 76 to enable switch 54 to de-energize actuator 142, so escapement lever 126 could prevent any appreciable further rotation of stepping wheel 102 and also could start levers 150 and 160 back toward the position of FIG. 2. The resulting advancement of the price selection cam 106 represented a credit of twenty-five cents.

FIG. 4 shows three of the infinite number of positions which a quarter will occupy as it passes through the passageway 36. The middle position shows a quarter after it has engaged the coin-receiving portion 90, has rotated that portion from the position of FIG. 2 to the position of FIG. 4, and is continuing to move downwardly past that portion. The lowermost position shows the quarter after it has moved the abutment 78 and lever 76 to their lower positions and is rolling to the right to release that abutment and that lever for returning movement to the positions of FIG. 2. The uppermost position shows a quarter, which was inserted immediately after a preceding quarter, resting upon the semi-cylindrical abutment 92 of lever 88.

Ordinarily, patrons do not insert quarters so rapidly that a second-inserted quarter will reach the semi-cylindrical abutment 92 before the preceding quarter has moved downwardly past the free end of coin-receiving portion 90 to permit lever 88 to move back up to the position of FIG. 2; and hence that semi-cylindrical abutment will not ordinarily intercept and hold a quarter. However, in the event a patron were to insert two quarters so rapidly that the second-inserted quarter would be intercepted and held by the semi-cylindrical abutment 92, that abutment would hold that quarter until the twenty-five cent value of the preceding quarter had been stored on the price selection cam 106. Specifically, the spring 138 will, during the time the actuator 142 is energized, urge the free end of the escapement lever 130 downwardly against the vertically-directed portion of lever 150 with sufficient force to prevent rotation of the latter lever toward the position of FIG. 2. Consequently, the abutment 154, on the end of extension 152 of arm 151 of lever 150, will remain in the position of FIG. 4, wherein it lies in the path of the trailing end of semi-cylindrical abutment 92; and hence that abutment will prevent gravity-induced rotation of lever 88 back to the position of FIG. 2 until actuator 142 becomes de-energized. As a result, until the first-inserted quarter has moved downwardly past abutment 78 to free lever 76, until that lever has permitted switch 54 to de-energize actuator 142, and until escapement lever 126 has caused lever 160 and pivot 158 to rotate lever 150 far enough in the clockwise direction to move abutment 154 out of the path of semi-cylindrical abutment 92, the lever 88 will remain close to the position shown by FIG. 4. However, when abutment 154 starts moving back toward the position of FIG. 2, lever 88 will respond to the force of gravity and also to the sideways movement of abutment 154 to start moving back to the position of FIG. 2. As the semi-cylindrical abutment 92 approaches the position of FIG. 2 it will permit the second-inserted quarter held thereby to move downwardly to engage and rotate the coin-receiving portion 90. During the consequent rotation of lever 88 to the position of FIG. 4, levers 150 and 160, switch 54, actuator 142, the escapement mechanism 126, 130 and 138, and the motion limiter 170 will effect a further storing of twenty-five cents on the price selection cam 106.

Conclusion

The coin-handling device of the present invention requires only two active electrical elements, namely, switch 54 and actuator 142 plus the mechanical elements associated with that switch and actuator to accept coins of three different values and to establish corresponding credits on the price selection cam 160. As a result, that coin-handling device requires fewer electrical components than does the EM or the L-E-D EM. The elimination of those electrical components saves the cost of those components, saves the cost of the wires and connections used with those components, and also saves the cost of connecting those components into the circuit. In this way, the coin-handling device provided by the present invention provides a less expensive, but equally reliable, coin-handling device for use in coin changers.

The coin-handling device of the present invention will respond to the insertion of coinage, having a value equal to the price set by the price selection cam 106, to advance that cam far enough to enable it to close the credit switch, not shown; and that coin-handling device will respond to the insertion of coinage, having a value greater than the price set by the price selection cam 106, to advance that cam byond the position wherein it will close the switch. Thereafter, the EM or the L-E-D EM will initiate a vending cycle and, where appropriate, dispense change before it re-sets itself. Also, the EM or the L-E-D EM will pull the rod 122 downwardly to return gear segment 110 and stepping wheel 102 to the positions of FIGS. 2 and 5. All of this means that when the coin-handling device of the present invention is substituted for the credit system of the EM or of the L-E-D EM, the resulting overall device will have fewer electrical components but will perform all of the functions of an EM or of an L-E-D EM.

Whereas the drawing and accompanying description have shown and described one preferred embodiment of the present invention, it should be apparent to those skilled in the art that various changes may be made in the form of the invention without affecting the scope thereof.

What I claim is:

1. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which responds to the insertion of said first coin to actuate said switch and to cause said electromechanical actuator to effect movement of said movable credit-establishing element through said first distance, a second means which is responsive to the insertion of said second coin and which includes said switch and said electromechanical actuator and which responds to the insertion of said second coin to actuate said switch and to cause said electromechanical actuator to effect movement of said movable credit-establishing element through said second distance, and a third means which is responsive to the insertion of said third coin and which includes said switch and said electromechanical actuator and which responds to the insertion of said third coin to actuate said switch and to cause said electromechanical actuator to effect movement of said movable credit-establishing element through said third distance, said switch and said electromechanical actuator being the only active electrical elements needed to initiate movement of said movable credit-establishing element through any of said three distances.

2. A coin-handling device as claimed in claim 1 wherein said switch has an actuator and wherein said first means also includes a coin-receiving element that is movable by said first coin and that responds to the insertion of said first coin to move and thereby effect a closing of said switch by moving said switch actuator.

3. A coin-handling device as claimed in claim 1 wherein said electromechanical actuator responds to closing of said switch to move an escapement mechanism in one direction relative to said movable credit-establishing element, wherein said escapement mechanism has a portion thereof which tends to respond to movement of said escapement mechanism in said one direction to limit advancement of said movable credit-establishing element to said first distance, wherein a mechanical linkage responds to movement of a coin-responsive element by said third coin to keep said portion of said escapement mechanism from limiting advancement of said movable credit-establishing element to said first distance, and wherein a plurality of mechanical elements respond to said mechanical linkage to assume positions wherein they can halt said movable credit-establishing element, when said electromechanical actuator moves said escapement mechanism to said first position, after said movable credit-establishing element has moved through said third distance.

4. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said first means also including a coin-receiving element and a mechanical linkage, and said coin-receiving element responding to the insertion of said first coin to cause said mechanical linkage to effect a closing of said switch.

5. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said second means also including a first coin-receiving element and a second coin-receiving element, said first coin-receiving element responding to the insertion of said second coin to effect a closing of said switch, and said second coin-receivng element also responding to the insertion of said second coin to effect a closing of said switch.

6. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said second means also including a first coin-receiving element and a second coin-receiving element and a link which interconnects said coin-receiving elements for conjoint movement, movement of one of said coin-receiving elements effecting a closing of said switch, said second coin directly moving said one coin-receiving element to effect a closing of said switch, and said second coin directly moving the other of said coin-receiving elements to cause said link to move said one coin-receiving element and thereby effect a closing of said switch.

7. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said second means also including a first coin-receiving element and a second coin-receiving element and a link which interconnects said coin-receiving elements for conjoint movement, one of said coin-receiving elements having an abutment thereon which responds to movement of said one coin-receiving element to effect a closing of said switch, said second coin directly moving said one coin-receiving element to cause said abutment to effect a closing of said switch, and said second coin directly moving the other of said coin-receiving elements to cause said link to move said one coin-receiving element and thereby cause said abutment to effect a closing of said switch.

8. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said first means also including a coin-receiving element, said second means also including said coin-receiving element and a second coin-receiving element, the first said coin-receiving element responding to the insertion of said first coin to effect a closing of said switch or responding to the insertion of said second coin to effect a closing of said switch, and said second coin-receiving element responding to the insertion of said second coin to effect a closing of said switch.

9. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said first means also including a first coin-receiving element and a second coin-receiving element and a link which interconnects said coin-receiving elements for conjoint movement, said second means also including said first coin-receiving element and said second coin-receiving element and said link, said first coin-receiving element responding to the insertion of said first coin to cause said link to move said second coin-receiving element and thereby effect a closing of said switch, said first coin-receiving element responding to the insertion of said second coin to cause said link to move said second coin-receiving element and thereby effect a closing of said switch, and said second coin-receiving element responding to the insertion of said second coin to effect a closing of said switch.

10. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said second means also including a first coin-receiving element and a second coin-receiving element and a coin-retarding element, said first coin-receiving element and said coin-retarding element and said second coin-receiving element being disposed so each second coin successively engages said first coin-receiving element and said coin-retarding element and said second coin-receiving element, said first coin-receiving element responding to the insertion of said second coin to effect a closing of said switch, said second coin-receiving element also responding to the insertion of said second coin to effect a closing of said switch, and said coin-retarding element permitting said first coin-responsive element to return to switch-opening position before it permits said second coin to engage said second coin-responsive element.

11. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, a third means which is responsive to the insertion of said third coin and which includes said switch and said electromechanical actuator and which effects movement of said movable credit-establishing element through said third distance, said switch and said electromechanical actuator being the only active electrical elements needed to initiate movement of said movable credit-establishing element through any of said three distances, said second coin moving through a passageway therefor, said second means also including a first coin-receiving element and a second coin-receiving element and a coin-retarding element, said first coin-receiving element and said coin-retarding element and said second coin-receiving element being disposed along the length of said passageway and having portions thereof normally disposed in said passageway so each second coin successively engages and moves said first coin-receiving element and engages and moves said coin-retarding element and engages and moves said second coin-receiving element, said first coin-receiving element responding to the movement thereof by said second coin to effect a closing of said switch, said second coin-receiving element also responding to movement thereof by said second coin to effect a closing of said switch, and said coin-retarding element permitting said first coin-responsive element to return to switch-opening position before it permits said second coin to engage said second coin-responsive element.

12. A coin-handling device which can accept a first coin of a first value and establish a credit corresponding to that value and which can accept a further coin of a further and different value and establish a credit corresponding to that further value, and which comprises a movable credit-establishing element that is movable through a first distance to establish a credit corresponding to the value of said first coin and that is movable through a further and different distance to establish a credit corresponding to the value of said further coin, a switch, an electromechanical actuator which responds to closing of said switch to initiate movement of said movable credit-establishing element, a first means which is responsive to the insertion of said first coin and which includes said switch and said electromechanical actuator and an escapement mechanism and which responds to the insertion of said first coin to actuate said switch and to cause said electromechanical actuator to effect movement of said movable credit-establishing element through said first distance, and a further means which is responsive to the insertion of said further coin and which includes said switch and said electromechanical actuator and said escapement mechanism and a mechanical linkage and which responds to said insertion of said further coin to actuate said switch and to cause said electromechanical actuator to effect movement of said movable credit-establishing element and also to cause said escapement mechanism to permit said movable credit-establishing element to move through said further distance, said switch and said electromechanical actuator being the only active electrical elements needed to initiate movement of said movable credit-establishing element through either of said two distances.

13. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which responds to the insertion of said first coin to actuate said switch and to cause said electromechanical actuator to effect movement of said movable credit-establishing element through said first distance, and a second means which is responsive to the insertion of said second coin and which includes said switch and said electromechanical actuator and which responds to the insertion of said second coin to actuate said switch and to cause said electromechanical actuator to effect movement of said movable credit-establishing element through said second distance, said switch and said electromechanical actuator being the only active electrical elements needed to initiate movement of said movable credit-establishing element through either of said two distances.

14. A coin-handling device as claimed in claim 13 wherein said switch has an actuator, and wherein said first means also includes a coin-receiving element that is movable to move said actuator of said switch and that responds to the insertion of said first coin to effect a closing of said switch.

15. A coin-handling device which can accept a first coin of a first value and establish a credit corresponding to that value and which can accept a further coin of a further and different value and establish a credit corresponding to that further value, and which comprises a movable credit-establishing element that is movable through a first distance to establish a credit corresponding to the value of said first coin and that is movable through a further and different distance to establish a credit corresponding to the value of said further coin, a switch, an electromechanical actuator which responds to closing of said switch to initiate movement of said movable credit-establishing element, a first means which is responsive to the insertion of said first coin and which includes said switch and said electromechanical actuator and an escapement mechanism and which effects movement of said movable credit-establishing element through said first distance, a further means which is responsive to the insertion of said further coin and which includes said switch and said electromechanical actuator and said escapement mechanism and a mechanical linkage and which responds to said insertion of said further coin to cause said escapement mechanism to permit said movable credit-establishing element to move through said further distance, said switch and said electromechanical actuator being the only active electrical elements needed to initiate movement of said movable credit-establishing element through either of said two distances, said electromechanical actuator responding to closing of said switch to move said escapement mechanism in one direction relative to said movable credit-establishing element, said escapement mechanism having a portion thereof which tends to respond to movement of said escapement mechanism in said one direction to limit advancement of said movable credit-establishing element to said first distance, said mechanical linkage responding to movement of said further coin-responsive element by said further coin to keep said portion of said escapement mechanism from limiting advancement of said movable credit-establishing element to said first distance, and a plurality of mechanical elements which respond to said mechanical linkage to assume positions wherein they can halt said movable credit-establishing element, when said electromechanical actuator moves said escapement mechanism to said first position, after said movable credit-establishing element has moved through said further distance.

16. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said first means also including a coin-receiving element and a mechanical linkage, and said coin-receiving element responding to the insertion of said first coin to cause said mechanical linkage to effect a closing of said switch.

17. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said second means also including a first coin-receiving element and a second coin-receiving element, said first coin-receiving element responding to the insertion of said second coin to effect a closing of said switch, and said second coin-receiving element also responding to the insertion of said second coin to effect a closing of said switch.

18. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said second means also including a first coin-receiving element and a second coin-receiving element and a link which interconnects said coin-receiving elements for conjoint movement, movement of one of said coin-receiving elements effecting a closing of said switch, said second coin directly moving said one coin-receiving element to effect a closing of said switch, and said second coin directly moving the other of said coin-receiving elements to cause said link to move said one coin-receiving element and thereby effect a closing of said switch.

19. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said second means also including a first coin-receiving element and a second coin-receiving element and a link which interconnects said coin-receiving elements for conjoint movement, one of said coin-receiving elements having an abutment thereon which responds to movement of said coin-receiving element to effect a closing of said switch, said second coin directly moving said one coin-receiving element to cause said abutment to effect a closing of said switch, and said second coin directly moving the other of said coin-receiving elements to cause said link to move said one coin-receiving element and thereby cause said abutment to effect a closing of said switch.

20. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said first means also including a coin-receiving element, said second means also including said coin-receiving element and a second coin receiving element, the first said coin-receiving element responding to the insertion of said first coin to effect a closing of said switch or responding to the insertion of said second coin to effect a closing of said switch, and said second coin-receiving element responding to the insertion of said second coin to effect a closing of said switch.

21. A coin-handling device which can accept a first coin of a first value and establish a credit corresponding to that value and which can accept a second coin of a second different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said first means also including a first coin-receiving element and a second coin-receiving element and a link which interconnects said coin-receiving elements for conjoint movement, said second means also including said first coin-receiving element and said second coin-receiving element and said link, said first coin-receiving element responding to the insertion of said first coin to cause said link to move said second coin-receiving element and thereby effect a closing of said switch, said first coin-receiving element responding to the insertion of said second coin to cause said link to move said second coin-receiving element and thereby effect a closing of said switch, and said second coin-receiving element responding to the insertion of said second coin to effect a closing of said switch.

22. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said second means also including a first coin-receiving element and a second coin-receiving element and a coin-retarding element, said first coin-receiving element and said coin-retarding element and said second coin-receiving element being disposed so each second coin successively engages said first coin-receiving element and said coin-retarding element and said second coin-receiving element, said first coin-receiving element responding to the insertion of said second coin to effect a closing of said switch, said second coin-receiving element also responding to the insertion of said second coin to effect a closing of said switch, and said coin-retarding element permitting said first coin-responsive element to return to switch-opening position before it permits said second coin to engage said second coin-responsive element.

23. A coin-handling device which can accept a first coin of a first value and establish a credit corresponding to that value and which can accept a second coin of a second and different value and establish a credit corresponding to that second value, and which comprises a movable credit-establishing element that is movable through a first distance to establish a credit corresponding to the value of said first coin and that is movable through a second and different distance to establish a credit corresponding to the value of said second coin, a switch, an electromechanical actuator which responds to closing of said switch to initiate movement of said movable credit-establishing element, a first means which is responsive to the insertion of said first coin and which includes said switch and said electromechanical actuator and which effects movement of said movable credit-establishing element through said first distance, a second means which is responsive to the insertion of said second coin and which includes said switch and said electromechanical actuator and which effects movement of said movable credit-establishing element through said second distance, said switch and said electromechanical actuator being the only active electrical elements needed to initiate movement of said movable credit-establishing element through either of said two distances, said second coin moving through a passageway therefor, said second means also including a first coin-receiving element and a second coin-receiving element and a coin-retarding element, said first coin-receiving element and said coin-retarding element and said second coin-receiving element being disposed along the length of said passageway and having portions thereof normally disposed in said passageway so each second coin successively engages and moves said first coin-receiving element and engages and moves said coin-retarding element and engages and moves said second coin-receiving element, said first coin-receiving element responding to the movement thereof by said second coin to effect a closing of said switch, said second coin-receiving element also responding to movement thereof by said second coin to effect a closing of said switch, and said coin-retarding element permitting said first coin-responsive element to return to switch-opening position before it permits said second coin to engage said second coin-responsive element.

24. A coin-handling device which can accept a coin and establish a credit corresponding to the value of that coin and which comprises a movable credit-establishing element that can be advanced to establish a predetermined credit corresponding to one half of the value of said coin, a passageway for said coin, a switch, an electromechanical actuator which responds to closing of said switch to initiate an advancement of said movable credit-establishing element, a first coin-receiving element which responds to the insertion of said coin to effect a closing of said switch, a second coin-receiving element which responds to the insertion of said coin to effect a closing of said switch, a coin-retarding element, said first coin-receiving element and said coin-retarding element and said second coin-receiving element being disposed along the length of said passageway so said coin successively engages and moves said first coin-receiving element and said coin-retarding element and said second coin-receiving element, said engagement and movement of said first coin-receiving element and of said second coin-receiving element by said coin effecting two closings of said switch and thereby causing said electromechanical actuator to initiate two advancements of said movable credit-establishing element to establish two said predetermined credits, and said coin-retarding element permitting said first coin-responsive element to return to switch-opening position before it permits said coin to engage said second coin-responsive element.

25. A coin-handling device as claimed in claim 24 wherein a link holds said first coin-responsive element and said coin-responsive element for conjoint rotation, and wherein said coin-retarding element can move independently of said first coin-responsive element and of said second coin-responsive element.

26. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which responds to the insertion of said first coin to actuate said switch to effect movement of said movable credit-establishing element through said first distance, a second means which is responsive to the insertion of said second coin and which includes said switch and which responds to the insertion of said second coin to actuate said switch to effect movement of said movable credit-establishing element through said second distance, and a third means which is responsive to the insertion of said third coin and which includes said switch and which responds to the insertion of said third coin to actuate said switch to effect movement of said movable credit-establishing element through said third distance, said switch being the only switch needed to initiate movement of said movable credit-establishing element through any of said three distances.

27. A coin-handling device as claimed in claim 26 wherein said switch has an actuator and wherein said first means also includes a coin-receiving element that is movable by said first coin and that responds to the insertion of said first coin to move and thereby effect a closing of said switch by moving said switch actuator.

28. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said first means also including a coin-receiving element and a mechanical linkage, and said coin-receiving element responding to the insertion of said first coin to cause said mechanical linkage to effect a closing of said switch.

29. A coin-handling device which can accept a first coin of a first value and established a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said second means also including a first coin-receiving element and a second coin-receiving element, said first coin-receiving element responding to the insertion of said second coin to effect a closing of said switch, and said second coin-receiving element also responding to the insertion of said second coin to effect a closing of said switch.

30. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said second means also including a first coin-receiving element and a second coin-receiving element and a link which interconnects said coin-receiving elements for conjoint movement, movement of one of said coin-receiving elements effecting a closing of said switch, said second coin directly moving said one coin-receiving element to effect a closing of said switch, and said second coin directly moving the other of said coin-receiving elements to cause said link to move said one coin-receiving element and thereby effect a closing of said switch.

31. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said second means also including a first coin-receiving element and a second coin-receiving element and a link which interconnects said coin-receiving elements for conjoint movement, one of said coin-receiving elements having an abutment thereon which responds to movement of said one coin-receiving element to effect a closing of said switch, said second coin directly moving said one coin-receiving element to cause said abutment to effect a closing of said switch, and said second coin directly moving the other of said coin-receiving elements to cause said link to move said one coin-receiving element and thereby cause said abutment to effect a closing of said switch.

32. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said first means also including a coin-receiving element, said second means also including said coin-receiving element and a second coin-receiving element, the first said coin-receiving element responding to the insertion of said first coin to effect a closing of said switch or responding to the insertion of said second coin to effect a closing of said switch, and said second coin-receiving element responding to the insertion of said second coin to effect a closing of said switch.

33. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said first means also including a first coin-receiving element and a second coin-receiving element and a link which interconnects said coin-receiving elements for conjoint movement, said second means also including said first coin-receiving element and said second coin-receiving element and said link, said first coin-receiving element responding to the insertion of said first coin to cause said link to move said second coin-receiving element and thereby effect a closing of said switch, said first coin-receiving element responding to the insertion of said second coin to cause said link to move said second coin-receiving element and thereby effect a closing of said switch, and said second coin-receiving element responding to the insertion of said second coin to effect a closing of said switch.

34. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable-credit establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said second means also including a first coin-receiving element and a second coin-receiving element and a coin-retarding element, said first coin-receiving element and said coin-retarding element and said second coin-receiving element being disposed so each second coin successively engages said first coin-receiving element and said coin-retarding element and said second coin-receiving element, said first coin-receiving element responding to the insertion of said second coin to effect a closing of said switch, said second coin-receiving element also responding to the insertion of said second coin to effect a closing of said switch, and said coin-retarding element permitting said first coin-responsive element to return to switch-opening position before it permits said second coin to engage said second coin-responsive element.

35. A coin-handling device which can accept a first coin of a first value and establish a credit corresponding to that value, which can accept a second coin of a second and different value and establish a credit corresponding to that second value, and which can accept a third coin of a third and still different value and establish a credit corresponding to that third value, and which comprises a movable credit-establishing element that is movable through a first distance to establish a credit corresponding to the value of said first coin, that is movable through a second and different distance to establish a credit corresponding to the value of said second coin and that is movable through a third and still different distance to establish a credit corresponding to the value of said third coin, a switch, a first means which is responsive to the insertion of said first coin and which includes said switch and which effects movement of said movable credit-establishing element through said first distance, a second means which is responsive to the insertion of said second coin and which includes said switch and which effects movement of said movable credit-establishing element through said second distance, and a third means which is responsive to the insertion of said third coin and which includes said switch and which effects movement of said movable credit-establishing element through said third distance, said switch being the only switch needed to initiate movement of said movable credit-establishing element through any of said three distances, said second coin moving through a passageway therefor, said second means also including a first coin-receiving element and a second coin-receiving element and a coin-retarding element, said first coin-receiving element and said coin-retarding element and said second coin-receiving element being disposed along the length of said passageway and having portions thereof normally disposed in said passageway so each second coin successively engages and moves said first coin-receiving element and engages and moves said coin-retarding element and engages and moves said second coin-receiving element, said first coin-receiving element responding to the movement thereof by said second coin to effect a closing of said switch, said second coin-receiving element also responding to movement thereof by said second coin to effect a closing of said switch, and said coin-retarding element permitting said first coin-responsive element to return to switch-opening position before it permits said second coin to engage said second coin-responsive element.

36. A coin-handling device which can accept a coin and establish a credit corresponding to the value of that coin and which comprises a movable credit-establishing element that can be advanced to establish a predetermined credit corresponding to one half of the value of said coin, a passageway for said coin, a switch, an electromechanical actuator which responds to closing of said switch to initiate an advancement of said movable credit-establishing element, a first coin-receiving element which responds to the insertion of said coin to effect a first closing of said switch, a second coin-receiving element which responds to the insertion of said coin to effect a second closing of said switch, said first coin-receiving element and said second coin-receiving element being disposed along the length of said passageway so said coin successively engages and moves said first coin-receiving element to provide said first closing of said switch and then engages and moves said second coin-receiving element to provide said second closing of said switch, said engagement and movement of said first coin-receiving element and of said second coin-receiving element by said coin effecting two successive closings of said switch and thereby causing said electromechanical actuator to initiate two successive advancements of said movable credit-establishing element to establish two said predetermined credits.

37. A coin-handling device which can accept a coin and establish a credit corresponding to the value of that coin and which comprises a movable credit-establishing element, a switch, an electromechanical actuator which responds to closing of said switch to initiate credit-establishing movement of said movable credit-establishing element, mechanical members which can fix a predetermined distance through which said movable credit-establishing element should move, one of said mechanical members being engaged and moved by said coin to enable said mechanical members to fix said predetermined distance through which said movable credit-establishing element should move, and a coin-responsive element which is movable by said coin to effect a closing of said switch, said one of said mechanical members being disposed close enough to said coin-responsive element so said one of said mechanical members will respond to the insertion of said coin to move to a moved position and will remain in said moved position until said coin engages and has moved said coin-responsive element to switch-closing position.

38. A coin-handling device as claimed in claim 37 wherein another of said mechanical members is normally held against movement by said one mechanical member until said one mechanical member is moved by a coin, and wherein said other mechanical member is held in its moved position while said actuator is energized by the closing of said switch.

39. A coin-handling device as claimed in claim 37 wherein an escapement mechanism is associated with said movable credit-establishing element, and wherein said other mechanical member disables said escapement mechanism whenever said other mechanical member is in its moved position.

40. A coin-handling device as claimed in claim 37 wherein another of said mechanical members is normally held against movement by said one mechanical member until said one mechanical member is moved by a coin, wherein said other mechanical member is held in its moved position while said actuator is energized by the closing of said switch, and wherein said other mechanical member acts, whenever it is in said moved position, to hold said one mechanical member against movement back to the position which it occupied before said coin moved it.

41. A coin-handling device as claimed in claim 37 wherein another of said mechanical members is normally held against movement by said one mechanical member until said one mechanical member is moved by a coin, wherein said other mechanical member is held in its moved position while said actuator is energized by the closing of said switch, wherein said one mechanical member has a coin-interrupting abutment thereon, wherein said abutment is out of coin-intercepting position whenever said one mechanical member is in the position which it occupied before said coin moved it, and wherein said coin-interrupting abutment is in coin-intercepting position whenever said one mechanical member is in its said moved position.

* * * * *